US010400563B2

(12) United States Patent
Mo et al.

(10) Patent No.: US 10,400,563 B2
(45) Date of Patent: Sep. 3, 2019

(54) PYROLYSIS TO PRESSURISE OIL FORMATIONS

(71) Applicant: Shell Oil Company, Houston, TX (US)

(72) Inventors: Weijian Mo, Sugar Land, TX (US); John Michael Karanikas, Houston, TX (US); Bernardus Van Den Brule, Houston, TX (US)

(73) Assignee: Salamander Solutions, LLC, Houson, TX (US)

( * ) Notice: Subject to any disclaimer, the term of this patent is extended or adjusted under 35 U.S.C. 154(b) by 415 days.

(21) Appl. No.: 14/949,517

(22) Filed: Nov. 23, 2015

(65) Prior Publication Data

US 2016/0145985 A1 May 26, 2016

Related U.S. Application Data

(60) Provisional application No. 62/084,210, filed on Nov. 25, 2014.

(51) Int. Cl.
*E21B 43/24* (2006.01)
*E21B 43/30* (2006.01)

(52) U.S. Cl.
CPC ..... *E21B 43/24* (2013.01); *E21B 43/2401* (2013.01); *E21B 43/2405* (2013.01); *E21B 43/305* (2013.01)

(58) Field of Classification Search
CPC ..... E21B 43/24; E21B 43/243; E21B 43/30; E21B 43/2401; E21B 43/247; E21B 43/2405
See application file for complete search history.

(56) References Cited

U.S. PATENT DOCUMENTS 3,515,213 A 6/1970 Prats
3,759,574 A * 9/1973 Beard ..... E21B 43/2405 166/271
4,366,986 A * 1/1983 Bohn ..... E21C 41/24 166/259
4,401,163 A * 8/1983 Elkins ..... C10G 1/02 166/259

(Continued)

OTHER PUBLICATIONS

International Search Report dated Jan. 8, 2016 of PCT/US2015/062175 filed Nov. 23, 2015.

*Primary Examiner* — Daniel P Stephenson

(57) ABSTRACT

Methods and systems for treating a subsurface hydrocarbon formation are described herein. In some embodiments, method for treating a subsurface hydrocarbon formation is provide wherein the hydrocarbon formation comprises a kerogen containing formation that is adjacent to a formation containing liquid hydrocarbons and not having a natural recharging system, the method comprising the steps of: providing heat sources in the kerogen containing formation; energizing the heat sources to heat the kerogen containing formation; heating at least a portion of the kerogen containing formation to a temperature and for a time period sufficient to pyrolyze at least some of the kerogen; limiting production of pyrolyzed hydrocarbons so that the pyrolyzed hydrocarbons increase the pressure within the formation containing liquid hydrocarbons; and producing hydrocarbons from the formation containing liquid hydrocarbons.

16 Claims, 3 Drawing Sheets

(56) References Cited

U.S. PATENT DOCUMENTS 4,817,711 A * 4/1989 Jeambey ..... E21B 43/2401 166/248
4,886,118 A * 12/1989 Van Meurs ..... E21B 36/04 166/248
5,392,854 A 2/1995 Vinegar et al.
6,688,387 B1 2/2004 Wellington et al.
6,698,515 B2 3/2004 Karankikas et al.
6,782,947 B2 8/2004 de Rouffignac et al.
6,880,633 B2 4/2005 Wellington et al.
6,991,036 B2 1/2006 Sumnu-Dindoruk et al.
6,991,045 B2 1/2006 Vinegar et al.
7,073,578 B2 7/2006 Vinegar et al.
7,121,342 B2 10/2006 Vinegar et al.
7,320,364 B2 1/2008 Fairbanks
7,527,094 B2 5/2009 McKinzie et al.
7,533,719 B2 5/2009 Hinson et al.
7,562,707 B2 7/2009 Miller
7,584,789 B2 9/2009 Mo et al.
7,635,024 B2 12/2009 Karanikas et al.
7,673,681 B2 3/2010 Vinegar et al.
7,677,310 B2 3/2010 Vinegar et al.
7,677,314 B2 3/2010 Hsu
7,681,647 B2 3/2010 Mudunuri et al.
7,717,171 B2 5/2010 Stegemeier et al.
7,739,947 B2 6/2010 Hoffjann et al.
7,798,220 B2 9/2010 Vinegar et al.
7,841,401 B2 11/2010 Kuhlman et al.
7,841,408 B2 11/2010 Vinegar
8,172,335 B2 5/2012 Burns et al.
8,789,586 B2 7/2014 de Rouffignac et al.
9,016,370 B2 4/2015 Daub et al.
2003/0173081 A1 9/2003 Vinegar et al.
2003/0178191 A1* 9/2003 Maher ..... C09K 8/592 166/65.1
2008/0087427 A1 4/2008 Kaminsky et al.
2008/0257552 A1* 10/2008 Shurtleff ..... E21B 43/24 166/272.6
2009/0189617 A1 7/2009 Burns et al.
2010/0101793 A1 4/2010 Symington et al.
2010/0258265 A1 10/2010 Karanikas et al.
2011/0186295 A1 8/2011 Kaminsky et al.
2011/0247806 A1 10/2011 Harris
2011/0247808 A1 10/2011 Nguyen
2011/0247814 A1 10/2011 Karanikas et al.
2011/0247820 A1 10/2011 Marino et al.
2015/0329785 A1* 11/2015 Vinegar ..... C10L 1/04 507/242
2016/0145985 A1* 5/2016 Mo ..... E21B 43/24 166/302

* cited by examiner

PYROLYSIS TO PRESSURISE OIL FORMATIONS

RELATED PATENTS

This patent application claims priority to U.S. provisional application No. 61/084,210, filed on Nov. 25, 2014. This patent application incorporates by reference in its entirety each of U.S. Pat. No. 6,688,387 to Wellington et al.; U.S. Pat. No. 6,991,036 to Sumnu-Dindoruk et al.; U.S. Pat. No. 6,698,515 to Karanikas et al.; U.S. Pat. No. 6,880,633 to Wellington et al.; U.S. Pat. No. 6,782,947 to de Rouffignac et al.; U.S. Pat. No. 6,991,045 to Vinegar et al.; U.S. Pat. No. 7,073,578 to Vinegar et al.; U.S. Pat. No. 7,121,342 to Vinegar et al.; U.S. Pat. No. 7,320,364 to Fairbanks; U.S. Pat. No. 7,527,094 to McKinzie et al.; U.S. Pat. No. 7,584,789 to Mo et al.; U.S. Pat. No. 7,533,719 to Hinson et al.; U.S. Pat. No. 7,562,707 to Miller; U.S. Pat. No. 7,841,408 to Vinegar et al.; and U.S. Pat. No. 8,172,335 to Burns et al.; U.S. Patent Application Publication Nos. 2009-0189617 to Burns et al.; 20100258265 to Karanikas et al; 2011/0247806 to Harris; 2011/0247808 to Nguyen; 2011/0247820 to Marino et al.; 2011/0247814 to Karanikas et al.; 2012/0255730 to Daub et al.; and U.S. patent application Ser. No. 13/903,433 entitled "TREATING HYDROCARBON FORMATIONS USING HYBRID IN SITU HEAT TREATMENT AND STEAM METHODS" to CAO et al. filed Oct. 4, 2012.

BACKGROUND

Field of the Invention

The present invention relates generally to methods and systems for production of hydrocarbons and/or other products from various subsurface formations such as hydrocarbon containing formations.

Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations that were previously inaccessible and/or too expensive to extract using available methods. Chemical and/or physical properties of hydrocarbon material in a subterranean formation may need to be changed to allow hydrocarbon material to be more easily removed from the subterranean formation and/or increase the value of the hydrocarbon material. The chemical and physical changes may include in situ reactions that produce removable fluids, composition changes, solubility changes, density changes, phase changes, and/or viscosity changes of the hydrocarbon material in the formation.

Oil shale formations may be heated and/or retorted in situ to increase permeability in the formation and/or to convert the kerogen to hydrocarbons having an API gravity greater than 10°. In conventional processing of oil shale formations, portions of the oil shale formation containing kerogen are generally heated to temperatures above 370° C. to form low molecular weight hydrocarbons, carbon oxides, and/or molecular hydrogen. Some processes to produce bitumen from oil shale formations include heating the oil shale to a temperature above the natural temperature of the oil shale until some of the organic components of the oil shale are converted to bitumen and/or fluidizable material.

U.S. Pat. No. 3,515,213 to Prats, which is incorporated herein by reference, describes circulation of a fluid heated at a moderate temperature from one point within the formation to another for a relatively long period of time until a significant proportion of the organic components contained in the oil shale formation are converted to oil shale derived fluidizable materials.

U.S. Pat. No. 5,392,854 to Vinegar et al. discloses a process to produce hydrocarbons from diatomite or oil shale formations where production wells are provided, and completed with fractures. Rows of heaters are provided with the rows being parallel to the fractures of the production wells.

U.S. Pat. No. 7,562,707 to Miller and U.S. Pat. No. 7,635,024 to Karanikas, both of which are incorporated herein by reference, describe methods and heaters for treating a hydrocarbon containing formation that includes providing heat from a plurality of heaters to mobilize hydrocarbons in the hydrocarbon formation.

U.S. Pat. No. 7,798,220 to Vinegar et al.; U.S. Pat. No. 7,717,171 to Stegemeier; U.S. Pat. No. 7,841,401 to Vinegar et al.; U.S. Pat. No. 7,739,947 to Stegemeier et al.; U.S. Pat. No. 7,681,647 to Mundunuri et al.; U.S. Pat. No. 7,677,314 to Hsu; U.S. Pat. No. 7,677,310 to Vinegar et al.; and U.S. Pat. No. 7,673,681 to Vinegar et al., all of which are incorporated herein by reference, describe methods for treating hydrocarbon formations that include heating hydrocarbons layers with heaters in combination with a drive and/or oxidizing fluid.

Production of the liquid hydrocarbons from a liquid hydrocarbon containing formation can be problematic when formation containing the liquid hydrocarbons does not have a natural recharging system. When a hydrocarbon containing formation contains gas, the gas could provide a natural recharging system because when some of the hydrocarbons in the formation are removed, the pressure within the formation would decrease, and any gas in the formation would expand. Thus, hydrocarbons is such a formation could be produced.

Other natural recharging systems might include communication with an aquifer wherein brine or water could displace any removed hydrocarbons, and pressure within the formation would be maintained. Without a natural recharging system, production of liquid hydrocarbons is problematic. When a product well is drilled and completed within such a formation, some liquid hydrocarbons will drain into the production well, and could be produced, but after five to eight percent of the liquid hydrocarbons present are produced, the lack of a force to drive the hydrocarbons into the production well bore results in extremely slow subsequent production. The small recovery of liquid hydrocarbons may not justify production of oil from such formation.

Some light tight oil formations do not contain sufficient gas to drive the oils to production wells, and these formations are generally considered to not be economically producible. In general, at least a gas content of fifteen percent by volume of pore space in a light tight oil formation is considered to be necessary for the formation to be producible by existing methods.

As discussed above, there has been a significant amount of effort to produce hydrocarbons from hydrocarbon containing formations. At present, however, there are still many hydrocarbon containing formations that cannot be economically produced. Thus, there is a need for improved methods for heating of a hydrocarbon containing formation that contain kerogen or hydrocarbons and production of liquid hydrocarbons having desired characteristics from the hydrocarbon containing formation are needed.

SUMMARY

Methods and systems for treating a subsurface hydrocarbon formation are described herein. In some embodiments, method for treating a subsurface hydrocarbon formation is provide wherein the hydrocarbon formation comprises a kerogen containing formation that is adjacent to a formation containing liquid hydrocarbons and not having a natural recharging system, the method comprising the steps of: providing heat sources in the kerogen containing formation; energizing the heat sources to heat the kerogen containing formation; heating at least a portion of the kerogen containing formation to a temperature and for a time period sufficient to pyrolyze at least some of the kerogen; limiting production of pyrolyzed hydrocarbons so that the pyrolyzed hydrocarbons increase the pressure within the formation containing liquid hydrocarbons; and producing hydrocarbons from the formation containing liquid hydrocarbons.

In further embodiments, features from specific embodiments may be combined with features from other embodiments. For example, features from one embodiment may be combined with features from any of the other embodiments.

By lack of a naturally recharging system, it could be that the formation is not connected to a high pressure source. Also, a natural drive could come from insitu gas. This is often the case for light tight oil formations. A light tight oil formation which does not contain sufficient gas is considered to lack a natural recharging system. When a formation has a permeability of less than about a millidarcy, and contains less than about fifteen percent by volume of gas, the formation is considered to lack a naturally recharging system. A more permeable formation could also lack a natural recharging system in situations where the formation lacks a source of energy to drive liquids to a production well.

In further embodiments, treating a subsurface formation is performed using any of the methods, systems, power supplies, or heaters described herein.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
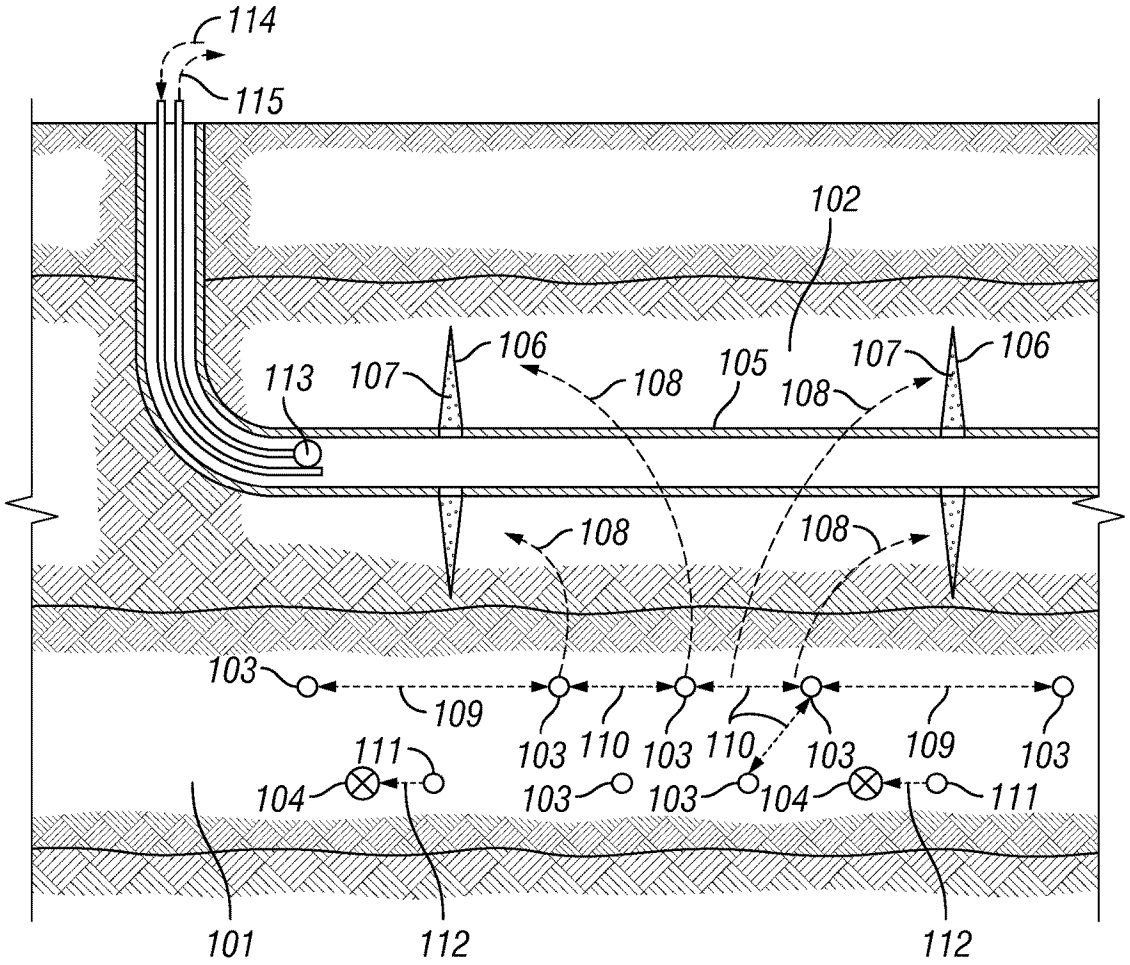
FIG. 1 depicts a schematic view of an embodiment of a portion of an in situ heat treatment system for treating a hydrocarbon containing formation.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"API gravity" refers to API gravity at 15.5° C. (60° F.). API gravity is as determined by ASTM Method D6822 or ASTM Method D1298.

A "fluid" may be, but is not limited to, a gas, a liquid, an emulsion, a slurry, and/or a stream of solid particles that has flow characteristics similar to liquid flow.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ hybrid treatment processes, the overburden and/or the underburden may include a hydrocarbon containing layer or hydrocarbon containing layers that are relatively impermeable and are not subjected to temperatures during in situ hybrid treatment processing that result in significant characteristic changes of the hydrocarbon containing layers of the overburden and/or the underburden. For example, the underburden may contain shale or mudstone, but the underburden is not allowed to heat to pyrolysis temperatures during the in situ hybrid treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

A "heat source" is any system for providing heat to at least a portion of a formation substantially by conductive and/or radiative heat transfer. For example, a heat source may include electrically conducting materials and/or electric heaters such as an insulated conductor, an elongated member, and/or a conductor disposed in a conduit. A heat source may also include an electrically conducting material and/or a heater that provides heat to a section proximate and/or surrounding a heating location such as a heater well.

A "heater" is any system or heat source for generating heat in a well or a near wellbore region. Heat sources may be, but are not limited to, electric heaters.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

"Insulated conductor" refers to any elongated material that is able to conduct electricity and that is covered, in whole or in part, by an electrically insulating material.

"Kerogen" is a solid, insoluble hydrocarbon that has been converted by natural degradation and that principally contains carbon, hydrogen, nitrogen, oxygen, and sulfur. Coal and oil shale are typical examples of materials that contain kerogen.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis section" refers to a volume of a formation (for example, a relatively permeable formation such as a tar sands formation) that is reacted or reacting to form a pyrolyzation fluid.

"Superposition of heat" refers to providing heat from two or more heat sources to a selected section of a formation such that the temperature of the formation at least at one location between the heat sources is influenced by the heat sources.

"Thickness" of a layer refers to the thickness of a cross section of the layer, wherein the cross section is normal to a face of the layer.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

Referring now to FIG. 1, a schematic of an embodiment of the present invention is shown. A kerogen containing formation 101 is shown adjacent to a formation containing liquid hydrocarbons 102. The kerogen containing formation could be an oil shale, or a coal formation, and could contain other hydrocarbons. For example, the kerogen could be a partially maturated kerogen wherein some hydrocarbons have been generated from the kerogen, and optionally at least some of the generated hydrocarbons have been expelled and some of the hydrocarbons remain in the pore volume within the kerogen containing formation. Such a formation might contain little connate water but might contain liquid hydrocarbons instead. Presence of such hydrocarbons significantly improve the economics of the process because hydrocarbon production begins earlier, and generally with relatively high value hydrocarbons. Such hydrocarbons could be relatively light hydrocarbons such as hydrocarbons having API gravities of between 20 and 40.

By the kerogen containing formation and the formation containing liquid hydrocarbons being adjacent is it to be understood that adjacent it intended to not exclude formations separated by intermediate layers so long as there is communication between the kerogen containing layer and the liquid hydrocarbon containing formation. For example, there could be relatively thin layers of permeable rock, or intermittent shelves of impermeable rock between the two formations, or both, so long as the generated hydrocarbons could flow from the kerogen containing formation to the liquid hydrocarbon containing formation.

The present invention could also be applied to multiple kerogen containing formations which could be separated by one or more formations containing liquid hydrocarbons. In such an application, one or more of the kerogen containing formations could be provided with heat sources such as heaters. The heaters could operate in an in situ conversion process to produce hydrocarbons from the kerogens, and the produced hydrocarbons could provide a drive for formations containing liquid hydrocarbons adjacent to the heated kerogen containing formation.

The formation containing liquid hydrocarbons 102 could contain at least some liquid hydrocarbons which have been generated and expelled from the kerogen containing formation, or could contain liquid hydrocarbons from other source rocks. The formation containing liquid hydrocarbons 102 does not contain a significant (more than five percent by weight) of kerogen. The formation containing liquid hydrocarbons will generally have a higher initial permeability than the kerogen containing formation, and could have a permeability of at least ten darcy. In an embodiment when the formation containing liquid hydrocarbons has a permeability of greater than ten darcy, fracturing of the formation may not be necessary in order to produce hydrocarbons after pyrolysis fluids from the kerogen containing formation pressurize the formation and provide driving energy to move hydrocarbons to production wells.

In one embodiment of the present invention, the kerogen containing formation is provided with heat sources 103. In FIG. 1, the heat sources are shown to be perpendicular to the plane of the figure. The heat sources could be electrical heaters, such as mineral insulated heaters, or could be tubulars through which a heat medium such as flue gas, or a molten salt is passed, or could be tubulars containing burners. Mineral insulated heaters could include an insulated conductor with an electrically conductive core which generates heat when electricity is passed through the core. The heater sources could also be antennas from which radio frequency are admitted. The heater sources in FIG. 1 are shown as horizontal heaters, but vertical heaters may be used, in particular if the formation is not too deep and the formation is relatively thick, for example, three hundred to one thousand meters deep and two hundred or more feet thick.

The heat sources in FIG. 1 are shown to be in a triangular pattern, but any pattern which results in coverage of the cross section of the formation with a desirable well spacing could be used. For formations which are deeper than about three hundred meters, it is generally less expensive to provide horizontal wells than to provide vertical wells. The heat sources are relatively closely spaced in order to provide sufficient heat to the formation to result in production of pyrolysis fluids in a reasonable time period. For example, the heat sources could be spaced from five to fifty meters from each other, or in other embodiments, from ten to twenty meters from each other.

The kerogen containing formation also includes production wells 104. Production wells 104 are shown located running along the bottom of the kerogen containing formation. Locating the production wells at the bottom of the formation may result in more production of liquids whereas locating production wells at the top of the formation may result in production of more gas products.

In some embodiments, one or more sections of the kerogen containing formation are heated to temperatures that allow for pyrolysis reactions in the formation. In some embodiments, the average temperature of one or more sections of the formation may be raised to pyrolysis temperatures of hydrocarbons in the sections (for example, temperatures ranging from 230° C. to 900° C., from 240° C. to 400° C. or from about 250° C. to 350° C.). pyrolysis products 112 flow by pressure gradient to production wells 104. Prior to pyrolysis, connate water may be vaporized to product steam. This steam also flows toward the production wells and also toward the formation containing hydrocarbon liquids, 102, due to pressure differential. Carbon dioxide could also be generated when the kerogen containing formation contains carbonate rocks, and liquid hydrocarbons within the kerogen containing formation could be vaporized, thus flowing toward either the formation containing hydrocarbon liquids 102 or the production wells 104. This flow of pyrolysis products also transfers heat from the vicinity of the heat sources.

Kerogen containing formations could initially have a low permeability. For example, an oil shale could have a permeability of less than 10 millidarcy. Vapors produced in the vicinity of the heat sources 103 therefore generate elevated pressures. Pressures in the vicinity of the heat sources will elevate as the temperature in the vicinity of the heat sources rise as a result of vaporization of water or liquid hydrocarbons, and after pyrolysis temperatures are reached, generation of pyrolysis products, until fracture pressures are reached. The formation will generate fractures, providing paths for vapors generated in the vicinity of the heat sources to flow to lower pressure regions, such as the production wells 104 or the formation containing liquid hydrocarbons 102. After conversion of a portion of the kerogens to pyrolysis products, the permeability of the kerogen containing formation increases substantially as a result of both removal of mass by the pyrolysis of kerogens, and by fractures created by the pressure of the products generated by the pyrolysis.

Heating the hydrocarbon containing formation with a plurality of heat sources may establish thermal gradients around the heat sources that raise the temperature of hydrocarbons in the formation to desired temperatures at desired heating rates. The rate of temperature increase through the mobilization temperature range and/or the pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

Superposition of heat from heat sources allows the desired temperature to be relatively quickly and efficiently established in the formation. Energy input into the formation from the heat sources may be adjusted to maintain the temperature in the formation substantially at a desired temperature.

Pyrolysis products may be produced from the formation through production wells. In some embodiments, between four and twenty heat sources may be provided for each production well of similar length. Or between four and twenty meters of heat sources may be provided for each meter of length of production well. In other embodiments, between five and ten meters of heat sources could be provided for each meter of production well. One feature of the present invention is that this ratio of heat sources, or length of heat sources to production wells, or total lengths of production wells, could include the total of wells in both the formation containing liquid hydrocarbons and the kerogen containing formation. For example, all of the heat sources could be in the kerogen containing formation and all of the production wells could be in the formation containing liquid hydrocarbons.

A production well is shown in the liquid hydrocarbon containing formation 105. The production well in the liquid hydrocarbons containing formation 105 may be a horizontal well, and provide with fracks, 106, the fracks may be parallel to the heater sources 103, and placed essentially centered between the heat sources so that the kerogen containing formation adjacent to the frack would be the lowest temperature of the kerogen containing formation and therefore the least permeable portion of the kerogen containing formation.

Production wells within the formation containing liquid hydrocarbons could be provided in the lower portion of the formation containing liquid hydrocarbons. This could enhance production of liquid hydrocarbons from the liquid hydrocarbon formation. A feature of the present invention may be that the production wells are placed within four meters of the bottom of the formation containing liquid hydrocarbons, or between about 0.1 meter and three meters.

The heat sources could be essentially equally spaced in FIG. 1, but another feature of the present invention could be that the distance between heat sources in the kerogen containing formation close to the fractures within the formation containing liquid hydrocarbons could be greater than the spacing of heat sources in the remainder of the formation. In this embodiment, the kerogen containing formation near the fractures could remain relatively cool, and therefore less permeable then the remainder of the kerogen containing formation. This could reduce or delay flows of pyrolysis products directly into the fractures from the kerogen containing formation, and force more flow of pyrolysis products into the formation containing hydrocarbon liquids between the fracture, resulting in greater recovery of the liquid hydrocarbons. For example, well spacing 109 between heat sources closest to the fractures could be between 1.1 and 2 times the well spacing 110 which are not near the fractures. Additionally, in the triangular pattern shown, heat sources 111 could be excluded from the pattern of heat sources. This embodiment would also place the product wells in the kerogen containing formation 104 in relatively cool locations. With the production wells located directly under the fractures, and thus in the cooler portion of the kerogen containing formation, flow of fluids into the production wells in the kerogen containing formation 104 would transfer more sensible heat to the formation, be produced cooler, and result in a marginal improvement in both the energy efficiency of the process, and reducing requirements for cooling the produced fluids.

Production of liquid hydrocarbons initially within the formation containing liquid hydrocarbons 102 into fractures 106, by providing energy in the form of pressurized formation liquids, in enhanced by restriction of production from production wells 104 to maintain an elevated pressure within both the kerogen containing formation 101, and the formation containing liquid hydrocarbons. Another feature of the invention is that liquids are produced from production wells 104, and production of vapors from production wells 104 is minimized Vapors produced by pyrolysis, vaporization of connate water or liquid oils originally in the kerogen containing formation, or carbon dioxide produced by dissociation of carbonites, are forced to the formation containing liquid hydrocarbons.

In an embodiment where the formation containing the liquid hydrocarbons 102 is below the kerogen containing formation 101, provision of production wells in the kerogen containing formation could be eliminated, and flow from of both vapor and liquid products could be captured from production wells within the formation containing liquid hydrocarbons. Alternatively, it may be beneficial to include production wells in the kerogen containing formation when the kerogen containing formation is above the formation containing liquid hydrocarbon, for example, to control the pressure in the kerogen containing formation to prevent loss of hydrocarbons by fracturing adjacent formations.

An artificial lift system 113 could be provided. For example, an electrical submersible pump, gas lift, or sucker rod pump, could be provided as an artificial lift system. Removing liquids from the wellbore would minimize the pressure on the formation and increase flow of fluids into the wellbore, and increase sweep of produced fluids from the kerogen. Decreasing the pressure of the production wells could increase sweep of produced fluids from the kerogen containing formation through the formation containing liquid hydrocarbons. Decreasing the pressure in the production wells also decreases the pressure in the kerogen containing formation in the regions where pyrolysis is occurring, enabling heavier hydrocarbons to be vaporized that that point.

The artificial lift system could remove liquid pyrolysis products and produced liquid hydrocarbon stream 115 from the production well. Depending on the temperature of the production wells 105, fluids could be provided from the surface through a conduit 114 to the artificial lift system 113 to control the temperature of the artificial lift system. The fluids could be water, recycled produced fluids, or a portion of the produced fluids stream. These cooling fluids could be provided after a period of operation of the in-situ conversion process without such cooling fluids. Upon initial production from the production wells 105, the formations around the production wells would still be sufficiently cool so that the cooling fluids would not be needed. Eventually, the temperature of the production well and produced fluids 108 could reach an elevated temperature and operation of the artificial lift system 113 could be enhanced by provision of cooling fluids.

The system described in FIG. 1 could be operated in such a way that production of liquid hydrocarbons over the course of the operation is increased. For example, by controlling the backpressure in the formation containing liquid hydrocarbons by restricting flow of vapors from the production well 105, the pressure in both the formation containing liquid hydrocarbons and the kerogen containing formation can be affected. In general, the pressure in the production well 105 could be minimized by minimizing restrictions to flow of vapors from a wellhead provided at the surface for production well 105, or using a compressor, blower, ejector, or vacuum pump to draw vapors from the production well. Also, the pressure seen by the formations could be reduced by minimizing any fluid within the production well 105 to minimize the hydraulic head seen as backpressure on the formations in the vicinity of the fractures 106. This could be accomplished by removing liquids using artificial lift.

As the insitu conversion process progresses, production of hydrocarbons 108 from the kerogen containing formation may bypass portions of the formation containing liquid hydrocarbons 102. Initially, when the permeability of the formation containing liquid hydrocarbons 102 is low, for example, less than 20 milladarcy, liquids near the fractures will be produced. This may amount to, for example, two to five percent of the liquids initially within the formation. After this initial production, liquid production will decrease until vapors generated in vicinity of heaters in the kerogen containing formation provide a driving force to force hydrocarbons within the formation containing liquid hydrocarbons toward the production wells or the fractures provided from the production wells. It will become evident that vapors produced by pyrolysis or rock decomposition are driving hydrocarbons to the production well because production of liquids will increase rather than decline.

Eventually, the composition of vapors being produced from the production well will change, and reflect a composition more typical of pyrolysis products, indicating that vapors from the kerogen containing formation are bypassing portions of the formation still containing liquid hydrocarbons and fingering to the production well. For example, the vapors may contain increased amounts of carbon dioxide, ethane, and olefins. When this increase in concentration of carbon dioxide, ethane or olefins in produced gasses is detected, the pressure in the production well 105 could be increased, for example, by 500 to 5000 kPa. Increasing the pressure could decrease bypassing of vapors to the production well, and form a gas cap within the formation, and more effectively displacing liquid hydrocarbons in the formation containing liquid hydrocarbons.

Increasing the pressure in the formation containing kerogen during the insitu conversion process would generally hinder production of liquid hydrocarbons, so another aspect of the present invention is that after pressure is increased and production of additional liquid hydrocarbons from the formation containing liquid hydrocarbons is achieved, the pressure could then again be reduced, to further enhance production of hydrocarbons from the kerogen containing formation. This decrease in the pressure could be performed after production of liquids from the production wells decreases to a level similar to, equal to, or less than, the production rate at a time before pressure is increased.

Figure 2:
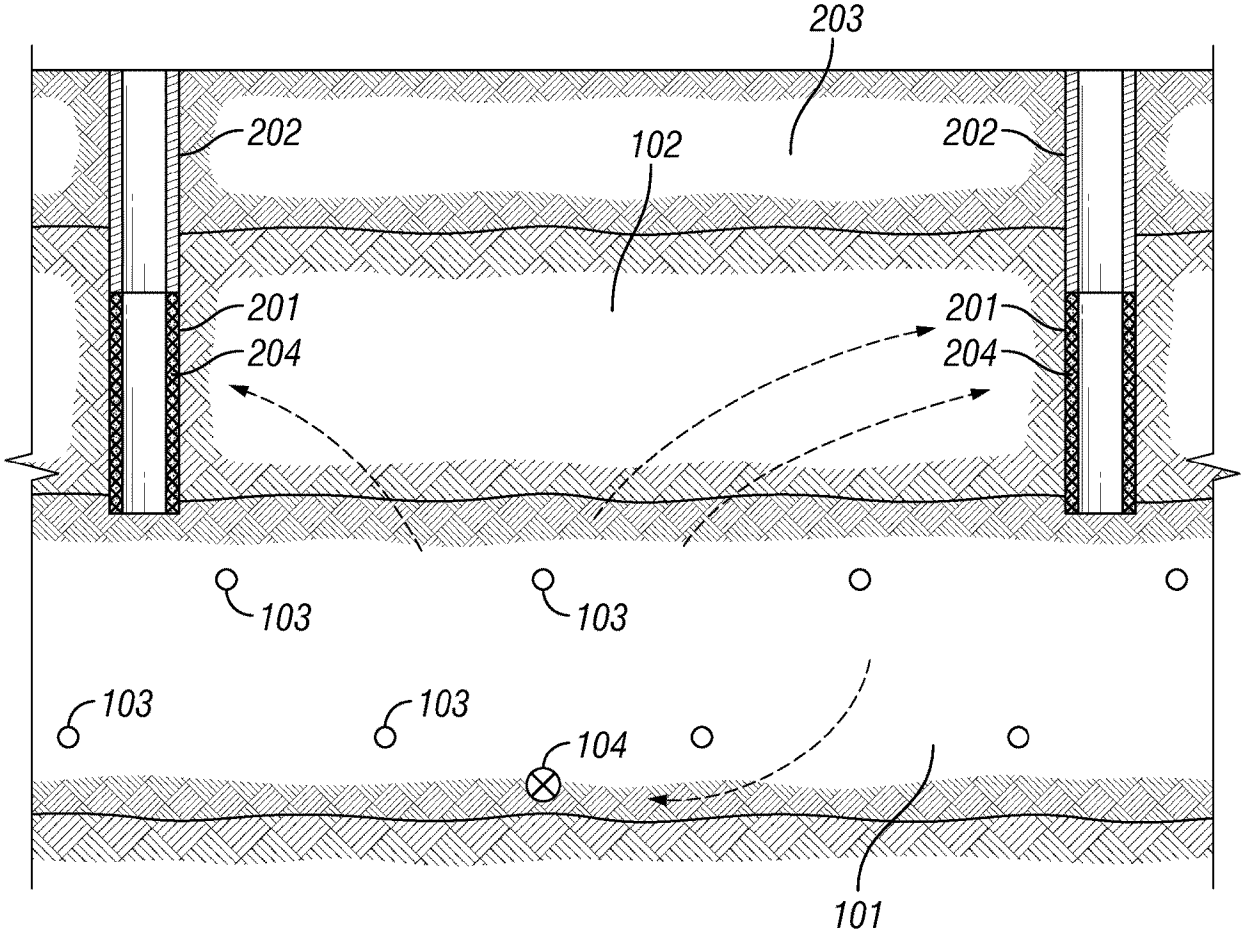
FIG. 2 depicts a schematic view of an alternative embodiment of a portion of an in situ heat treatment system for treating a hydrocarbon containing formation.

Referring now to FIG. 2, an alternative embodiment of the present invention is shown with like elements numbered as in FIG. 1. A kerogen containing formation 101 is shown below a formation containing liquid hydrocarbons 102 with heat sources 103 shown within the kerogen containing formation and a production well 104 in the kerogen containing formation below the level of the lower heat sources. Vertical production wells 201 are shown within the formation containing liquid hydrocarbons, with cemented casings 202 within the overburden 203, and sand packed screens 204 within the formation containing liquid hydrocarbons. An artificial lift system could be provided When the formation containing liquid hydrocarbons has a low permeability, provision of fractures in formation may considerably increase production. Methods for fracking formations are known in the art, and such fracks are typically provided by first perforation the wellbore, then pumping frack fluids into the perforations at pressures that exceed the pressure necessary to initiate a fracture in the formation, and continuing to pump fluids containing proppants such as sand, or ceramic particles into the fractures causing the fractures to propagate way from the wellbore. Prop pant within the fractures 107 then hold the fractures open after pressure of the fluids being pumped into the fractures is reduced. The fractures, or fracks, then provide additional flow paths for fluids to be produced from the formation. Formations having some liquid hydrocarbons, but low permeability are often referred to as light tight oil formations. Such formations generally need to be fractured to permit economic production of hydrocarbons, but even when fractured, unless the formation contains sufficient gas, there will not be sufficient driving force to push the liquids to the fractures.

The fractures 106 may be desirable depending on the permeability of the formation containing liquid hydrocarbons. There are many variables which effect the desirability of providing fractures, including factors that determine how difficult and expensive provision of the fracture along with the initial permeability of the formation.

Fractures will tend to stop propagation near interfaces between the target formation and adjacent formations for various reasons, including less cementation between the two layers, allowing the energy that is causing the frack to propagate to dissipate over a larger area of the adjacent formation and not continue the fracture into the next formation. For this reason, it may be desirable to place a horizontal production well in the formation containing liquid hydrocarbons in the lower portion of the formation. Having the production wellbore in the lower portion of the formation will enable higher recovery of liquid hydrocarbon by reduction of fluids within the fractures below the production wellbore.

In an embodiment of the present invention, the production wellbore in the formation containing liquid hydrocarbons is provided, and liquid hydrocarbon production is initiated prior to initiating an insitu conversion process in the kerogen containing formation. Thus, the pressure within the formation containing hydrocarbons is reduced, and flow of pyrolyzation fluids 108 from the kerogen containing formation into the formation containing liquid hydrocarbons is enabled and increased.

Figure 3:
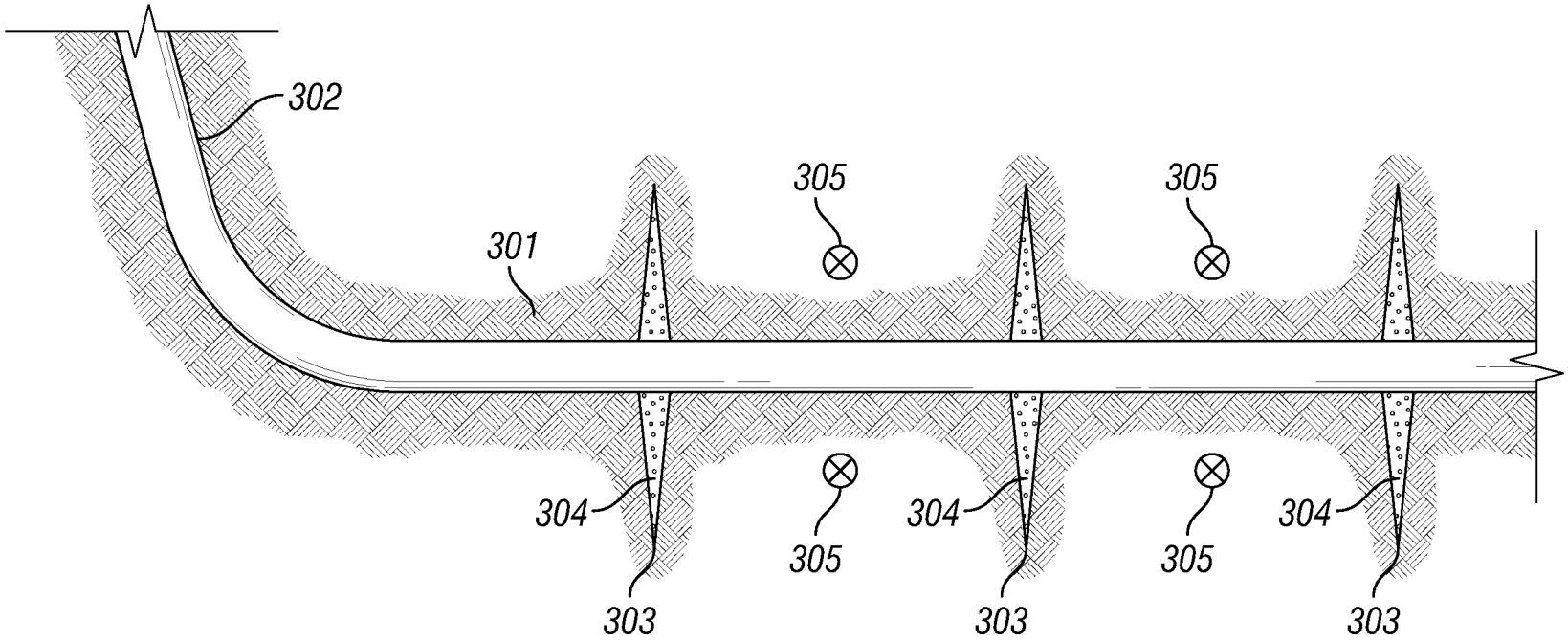
FIG. 3 depicts a schematic view of an alternative embodiment of the present invention.

Referring now to FIG. 3, an embodiment of the present invention is shown within a hydrocarbon containing formation 301. The hydrocarbon containing formation in this embodiment may have a permeability of less than ten millidarcy, and may contain less than fifteen percent gas content, and as such, would lack a natural drive to force liquids from the formation to a production well or fracture. A production well 302 is shown as a horizontal well completed with fractures 303 propped open with proppants 304. The fractures could be placed at intervals between, for example, 100 meters and 1000 meters, preferably between 150 meters and 300 meters. Heat sources 305 are shown in horizontal wells essentially parallel to the fractures, and in the embodiment show, essentially centered between adjacent fractures. In this embodiment, one heat is shown above the production well and one heat source is shown below the production well. The heat sources are shown in horizontal wells, but particularly in thick shallow formations, the heat sources could be placed in vertical wells. In a feature of this embodiment is that just one horizontal heat source could be provided between each adjacent set of fractures, and such a heat source could be provided below the production well in the lower portion of the formation.

In the embodiment of FIG. 3, only a relatively small portion of the formation is eventually heated to pyrolysis temperatures. For example, three to fifteen percent or five to ten percent of the formation is eventually heated to pyrolysis temperatures. Heating the formation to pyrolysis temperatures creates vapor hydrocarbons, along with vaporized connate water, and, if carbonate rocks are present in the formation, carbon dioxide from the carbonate rocks, which provides a driving force to move hydrocarbons into the production wells, or fractures if fractures are provided, Because of the high pressures that can be created by elevated temperatures around the heat sources, the pyrolysis products produce an effective drive by forming micro fractures.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

In this patent, certain U.S. patents and U.S. patent applications have been incorporated by reference. The text of such U.S. patents and U.S. patent applications is, however, only incorporated by reference to the extent that no conflict exists between such text and the other statements and drawings set forth herein. In the event of such conflict, then any such conflicting text in such incorporated by reference U.S. patents and U.S. patent applications are specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

We claim:

1. A method for treating a subsurface hydrocarbon formation, the hydrocarbon formation comprising a kerogen containing formation and a liquid hydrocarbon containing formation, the method comprising the steps of:

providing heat sources in the kerogen containing formation, the kerogen containing formation being adjacent to the formation containing liquid hydrocarbons, the formation containing liquid hydrocarbons (1) not containing more than five percent by weight of kerogen, (2) having an initial permeability of at least ten darcy, (3) having a permeabilitiy greater than the kerogen containing formation, and (4) not having a natural recharging system;

energizing the heat sources to heat the kerogen containing formation:

heating at least a portion of the kerogen containing formation to a temperature and for a time period sufficient to pyrolyze at least some of the kerogen and generating at least some vapor;

limiting production of pyrolyzed hydrocarbons so that the pyrolyzed hydrocarbons increase a pressure within the formation containing liquid hydrocarbons; and producing hydrocarbons from the formation containing liquid hydrocarbons wherein vapor resulting from the pyrolysis has forced at least some hydrocarbons within the formation containing liquid hydrocarbons toward the production wells.

2. The method of claim 1 further comprising the step of providing hydrocarbon production wells in the formation containing liquid hydrocarbons and wherein the hydrocarbons are produced from production wells located in the formation containing liquid hydrocarbons.

3. The method of claim 2 further comprising the step of providing hydrocarbon production wells in the kerogen containing formation and producing hydrocarbons from the production wells in the kerogen containing formation.

4. The method of claim 3 wherein the production wells in the kerogen containing formation are horizontal wells.

5. The method of claim 2 further comprising the step of fracking the production wells placed in the formation containing liquid hydrocarbons.

6. The method of claim 5 wherein a plurality of the heat sources are located in essentially horizontal wells and the fracks are located essentially centered between two heat sources.

7. The method of claim 1 wherein the heat sources are located in essentially horizontal wells.

8. The method of claim 7 wherein the horizontal producer wells are separated by between 100 and 1000 meters.

9. The method of claim 8 wherein the horizontal producer wells are separated by between 200 and 500 meters.

10. The method of claim 8 wherein the heat sources are placed in essentially horizontal wells and are spaced between 10 and 30 meters apart from each other.

11. The method of claim 1 wherein the at least forty percent of the hydrocarbons in the formation containing liquid hydrocarbons are produced from the formation.

12. The method of claim 1 wherein the formation containing liquid hydrocarbons has a permeability of less than ten darcy.

13. The method of claim 1 wherein the heat sources are electrical heaters.

14. The method of claim 1 wherein the heat sources are tubulars though which a heat medium is circulated.

15. The method of claim 14 wherein the heat medium is a molten salt.

16. The method of claim 1 wherein the pressure within the formation containing liquid hydrocarbons is initially maintained at a low pressure, and after production of pyrolysis products is detected in hydrocarbons produced from the formation containing liquid hydrocarbons, the pressure within the formation containing liquid hydrocarbons is increased by between 500 to 5000 kPa.

* * * * *